US006663256B1

(12) United States Patent
Gobbell

(10) Patent No.: US 6,663,256 B1
(45) Date of Patent: Dec. 16, 2003

(54) JEWELRY HAVING AN INDIRECT LIGHT SOURCE AND METHODS OF USE THEREOF

(76) Inventor: Ronald V. Gobbell, 217 Fifth Ave. North, Nashville, TN (US) 37219

( * ) Notice: Subject to any disclaimer, the term of this patent is extended or adjusted under 35 U.S.C. 154(b) by 0 days.

(21) Appl. No.: 10/108,099

(22) Filed: Mar. 27, 2002

(51) Int. Cl.[7] ..... F21V 21/08

(52) U.S. Cl. ..... 362/104; 362/103; 362/105; 362/106; 362/108; 362/191; 362/136; 362/295

(58) Field of Search ..... 362/104, 103, 362/191, 105, 295, 106, 108, 136; 63/1.1, 32

(56) References Cited

U.S. PATENT DOCUMENTS 3,790,775 A * 2/1974 Rosenblatt ..... 362/104
5,519,591 A * 5/1996 McCrary ..... 362/571
6,433,483 B1 * 8/2002 Michael et al. ..... 315/76
2001/0008074 A1 * 7/2001 Radley-Smith ..... 63/3
2002/0131266 A1 * 9/2002 Naghi et al. ..... 362/104

* cited by examiner

*Primary Examiner*—Sandra O'Shea
*Assistant Examiner*— Tsidulko
(74) *Attorney, Agent, or Firm*—Waddey & Patterson, P.C.; Douglas W. Schelling

(57) ABSTRACT

The present invention discloses an apparatus and method for enhancing the appearance of a subject. The apparatus used for illuminating and drawing attention to the surface of an individual comprises a blocking element, a light source, an energy source, and a mounting element, wherein the blocking element directs light emitted from the light source towards the surface of the subject wearing the apparatus. The method of illuminating and enhancing the appearance of a subject has a surface illuminator, illuminating the light source, reflecting light, attaching the surface illuminator to a surface of the subject, and illuminating the surface of the subject with light reflected from the blocking element. The method also includes the steps of turning the light source off and varying the intensity of the light source.

6 Claims, 3 Drawing Sheets

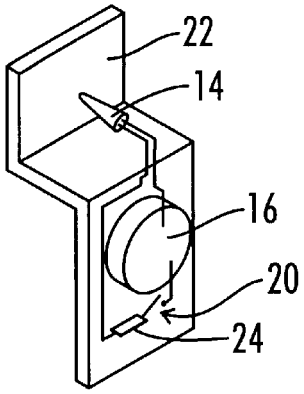
FIG. 10
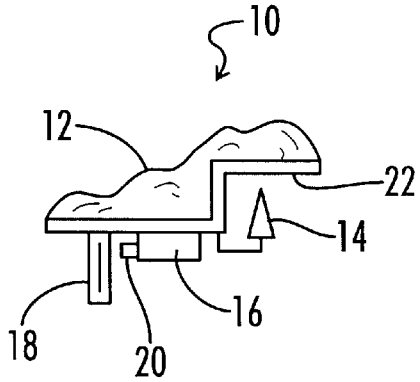
FIG. 11
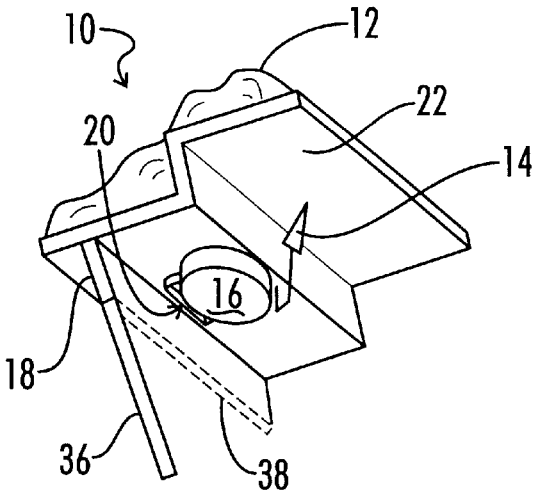
FIG. 12
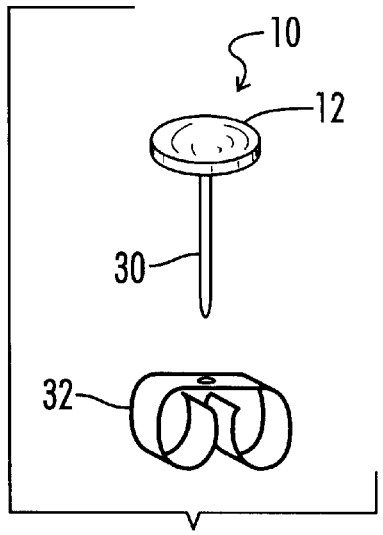
FIG. 13
FIG. 14
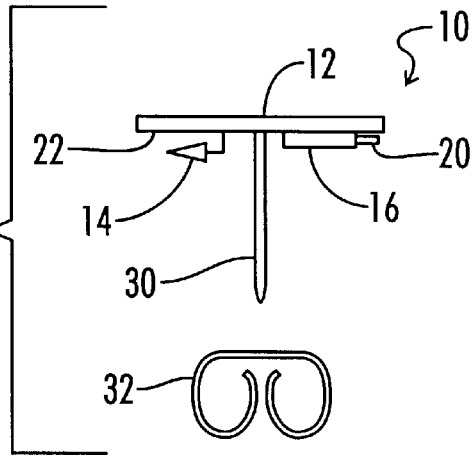

JEWELRY HAVING AN INDIRECT LIGHT SOURCE AND METHODS OF USE THEREOF

FIELD OF THE INVENTION

This invention relates generally to jewelry articles providing indirect light in order to enhance the appearance of the subject wearing the jewelry. More specifically, this invention relates to jewelry articles having light and energy sources which illuminate the subject rather than the jewelry article itself.

BACKGROUND OF THE INVENTION

Men and women have commonly used jewelry articles to enhance their appearance. Historically, there have been large markets for jewelry articles which are provided in many shapes and sizes. Since many of the jewelry articles offered historically have been manufactured of shiny or reflective surfaces, such as gold, silver, platinum, white gold, and hematite, a market was developed for jewelry articles having the ability to emit light. Jewelry articles which emit light have had commercial value because the light attracts the attention of admirers in a manner similar to that of the shiny or reflective surfaces historically used in jewelry.

A market does exist for the sale of jewelry articles that emit light. Up to this point the prior art provides jewelry articles in which the light is directed outwardly so that an admirer of the jewelry sees the light from the light source which illuminates, or highlights, the article of jewelry or portions thereof. Other uses of light emitting jewelry articles, wherein the light functions to illuminate a target other than the jewelry article, such as a part of the users body, have not been the subject of the prior art.

SUMMARY OF THE INVENTION

The present invention discloses an apparatus and method for enhancing the aesthetic value of an individual. More specifically, the aesthetics of an individual are enhanced by the illumination of the clothing or body parts of the individual. The apparatus includes a blocking element, a light source, an energy source, and a mounting element, also known as an attachment element. In certain embodiments, the apparatus additionally includes a light switch and/or a light control dial. The method includes providing a jewelry piece, illuminating the light source, reflecting light emitted from the light source, attaching the jewelry piece to an individual, and illuminating the individual. In certain embodiments, the method includes the step of attaching the jewelry piece to the individual in a fixed position. Other embodiments include the step of attaching the jewelry piece to an individual so that the jewelry piece is capable of movement. In certain embodiments, the method additionally includes the step of turning off the surface illuminator, or adjusting the intensity of the light coming from the surface illuminator.

Accordingly, one object of the present invention is to provide an apparatus used for enhancing the appearance of an individual.

Another object of the present invention is to provide an apparatus used to illuminate the clothing worn by an individual. The apparatus is capable of attaching to either articles of clothing, such as shirts, blouses, pants, dresses, socks, coats, sweaters, and belts, or a portion of the body.

Still another object of the present invention is to provide an apparatus and method of illuminating the surface of an individual. An enhanced presentation of an individual is possible with the illumination of portions of the body, such as the toes, ankles, abdomen, chest, wrist, fingers, neck, face, and hair.

Still another object of the present invention is to provide an apparatus and method of attracting attention to an individual.

BRIEF DESCRIPTION OF THE DRAWINGS

FIG. 10 is a perspective view showing an electrical diagram of an embodiment of the present invention.

FIG. 11 is a side elevation of a hair barrette according to the present invention.

FIG. 12 is a perspective view of a hair barrette showing the movement of the mounting element between an open position and a closed position, which is indicated by the dashed line.

FIG. 13 is a perspective view of an earring of the present invention.

FIG. 14 is a side elevation of an earring according to the present invention.

DESCRIPTION OF THE PREFERRED EMBODIMENTS

The present invention discloses an apparatus and method for illuminating the surface of an individual. The present invention will be described in detail by referring to the following figures and reference numbers.

As used herein, "blocking element" means a physical structure through which less than 50% of visible light is capable of passing. In certain embodiments, the blocking element may completely prohibit the passing of light. In other embodiments, the blocking element may have a reflective surface adapted to refract light. Examples of blocking elements include, but are not limited to, gold, silver, plastic, rubber, steel, non-transparent gemstones, artificial non-transparent gemstones, other forms of non-transparent metal, and leather.

As used herein "light source" means any apparatus capable of transforming electric energy into visible energy.

As used herein, "mounting element", also known as an attachment element, means a structure used for attaching an item, such as a blocking element, to either any body part of a person or any articles of clothing or accessories attached thereto. Examples of a mounting elements include, but are not limited to, hooks, straps, pins, necklaces, anklets, bracelets, watch bands, support frame of eyeglasses, attachment studs for earrings, belly rings, nipple rings, and other enclosures through which a body part or apparel accessory may be inserted.

As used herein "jewelly piece" means any ornament used for decoration regardless of the preciousness, rarity, or value of the structure. Examples of jewelry pieces include, but are not limited to, the ornamental or aesthetically pleasing portion of accessories such as rings, watches, bracelets, anklets, earrings, belly rings, nipple rings, pins, broaches, and hair barrettes.

As used herein, "light shield" has the same meaning as "blocking element."

Figure 1:
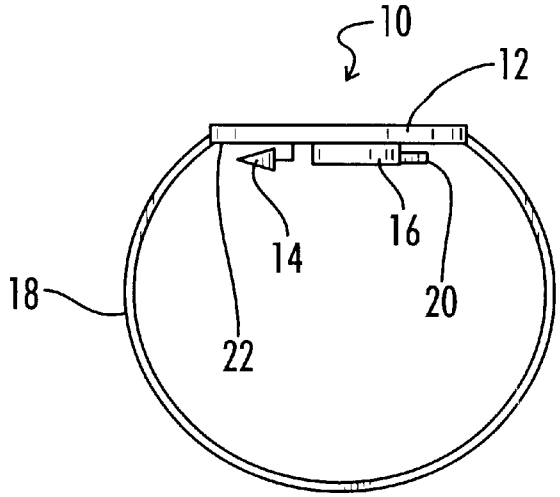
FIG. 1 is a side elevation of a bracelet according to the present invention.

FIG. 1 shows an embodiment of the present invention for a surface illuminator 10 comprising a blocking element 12, a light source 14, an energy source 16, and a mounting element 18, also known as an attachment element. This embodiment of the surface illuminator 10, also called a back-lighting apparatus, provides light which is directed inwardly such that it illuminates the surface of the wearer. More specifically, the light source is directed toward and connected to the blocking element so that when the apparatus is attached to a subject, the blocking element directs light from the light source toward the surface of the subject wearing the apparatus. In another embodiment of the present invention, the surface illuminator 10 may surround a body part, such as a wrist or ankle. Accordingly, when this first embodiment of the present invention is worn as a bracelet, anklet, arm band or watch band, the surface of the wearer will be illuminated while visualization of the direct light is prohibited by the blocking element 12.

As best shown in FIG. 1, the light source 14 is powered by the energy source 16. The light source 14 is connected to the blocking element 12 and the energy source 16 is also connected to the blocking element 12. FIG. 1 does not show the electrical connection between the light source 14 and the energy source 16, whereby energy is supplied so that the light source is illuminated.

Figure 2:
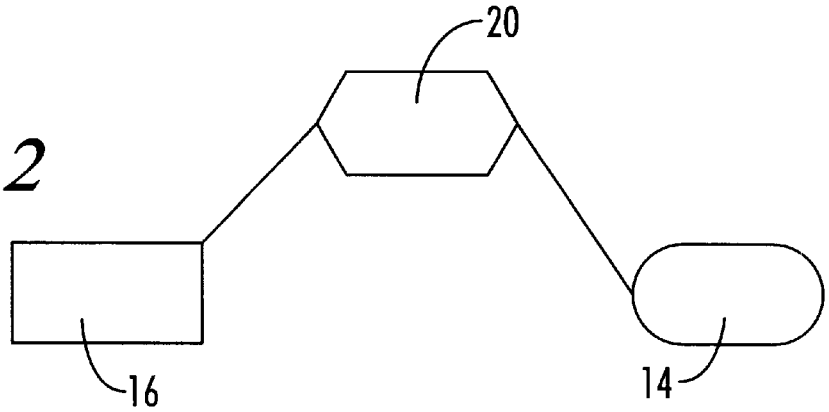
FIG. 2 is an electrical diagram of the energy source, light control, and light source of the present invention.

In certain embodiments of the present invention, the surface illuminator 10 has a light control 20 electrically connected to the energy source 16 so that the light source 14 may be turned on and off. The light control 20 allows the light source 14 to be turned on and off by a push button switch, a lever switch, or any other switching mechanism which interrupts the energy provided to the light source 14 in order to provide illumination thereof In certain embodiments of the present invention, in addition to controlling whether the light source 14 is on or off, the light control 20 further comprises a variable control electrically connected to the light source 14 so that the intensity of a light from the light source 14 may be varied from a maximum intensity to a minimum intensity. As best shown in FIG. 2, the light control 20 is electrically connected to the energy source 16 and electrically connected to the light source 14. The electrical connections are not shown in any figures other than FIG. 2.

As best shown in FIGS. 1, 3, 4, 5, 6, 9, 11, 12, 13 and 14, the blocking element 12 may be a jewelry piece. Since the function of the blocking element 12, also known as light shield, is to prohibit the direct visualization of the light source 14, many commonly known jewelry pieces may serve that function. As shown in FIGS. 3, 4, 5 and 6, a gemstone or other material in the shape of a gemstone may be the blocking element 12. As shown in FIGS. 1, 7, 8, 9, 10, 11, 12, 13 and 14, other ornamental structures may serve as the blocking element 12. By way of illustration, and not limitation, structures such as aluminum, metal, plastic, rubber, leather, fabric, adhesives, gold, silver, platinum, or hematite may be used to form the blocking element 12, also known as a light shield. Additional examples of materials which may be used as the blocking element 12, also known as the light shield, include a pendant, the ornamental portion of a belly button ring, a belt buckle, a belt, the ornamental portion of a bracelet, the ornamental portion of an anklet, a pin, the ornamental portion of an earring, eyeglasses, a hair barrette, a necklace, the ornamental portion of a nipple ring, the ornamental portion of a ring, a tiara, the ornamental portion of a toe ring, and the face of a watch. In other embodiments, the surface illuminator 10, or back-lighting apparatus, comprises a jewelry piece having a first side, a light source attached to the first side of the jewelry piece, so that the jewelry piece blocks direct visualization of light from the light source and redirects light to a surface of the subject, a battery, and an attachment element connected to the jewelry piece to allow attachment to an individual.

As best seen in FIGS. 1, 3, 7, 8, 9, 10, 11, 12, and 14, in certain embodiments of the present invention, the blocking element 12, also known as the light shield, has a first side 22 which is a light reflective surface.

The light source 14 is a component of the present invention which is capable of transforming electric energy into visible light. In certain embodiments, the light source is a light emitting diode (LED). In other embodiments of the present invention, the light source 14 is an incandescent light source. In still other embodiments of the present invention, the light source 14 is a fluorescent light source. In still other embodiments of the present invention, the light source 14 is a liquid crystal display (LCD). The light source 14 provides light such that the surface of the subject is illuminated for aesthetic purposes. The light source 14 does not generate sufficient heat, or produce any byproducts, chemical or otherwise, that are harmful to the surface of the subject. Accordingly, the surface illuminator 10 provides a source of illumination which is not harmful to skin, hair, or other fabrics or coverings which are commonly worn.

Figure 7:
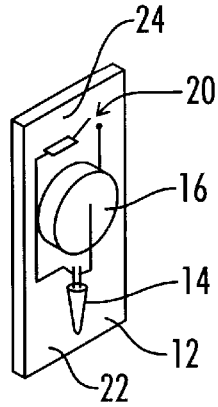
FIG. 7 is a perspective view showing an electrical diagram of an embodiment of the surface illuminator according to the present invention.

The surface illuminator 10 of the present invention provides an energy source 16 for the illumination of the light source 14. In certain embodiments of the present invention, the energy source 16 is a removable battery. In other embodiments, the energy source 16 may be any energy source known by those of ordinary skill in the art which would provide sufficient power to illuminate the light source 14 in the manner described herein. In other embodiments, the energy source 16 is a non-removable battery. In still other embodiments of the present invention, the energy source 16 is a removable battery capable of being recharged. As shown in FIG. 7 and 10, in certain embodiments, the surface illuminator 10 includes a resistor 24. The resistor 24 is used to match the electrical capabilities of the energy source 16 with the output ability of the light source 14.

Figure 3:
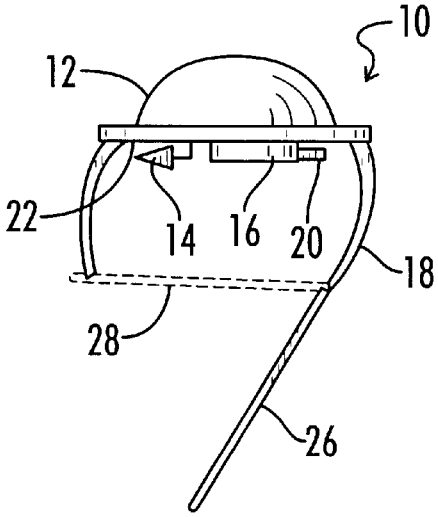
FIG. 3 is a side elevation of a belly ring according to the present invention. Also shown is the open position and closed position of the mounting element.
Figure 4:
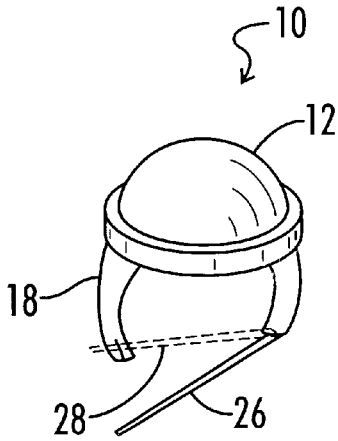
FIG. 4 is a perspective view of a belly ring according to the present invention. Also shown is the open position and closed position of the mounting element.

The present invention may be used to illuminate different portions of the surface of the wearer in order to enhance the aesthetic value of that surface. As shown in FIG. 1, the mounting element 18, also known as the attachment element, of the present invention may be used to attach the surface illuminator 10 to a wrist or ankle. As shown in FIG. 3, the mounting element 18 allows attachment to a surface having a piercing of the wearer. In certain embodiments, the mounting element 18 allows attachment to a pierced belly button. In other embodiments, the mounting element 18 allows attachment to a pierced nipple. As best shown in FIGS. 3 and 4, the mounting element 18, also known as the attachment element, has an open position 26 and a closed position 28.

Figure 5:
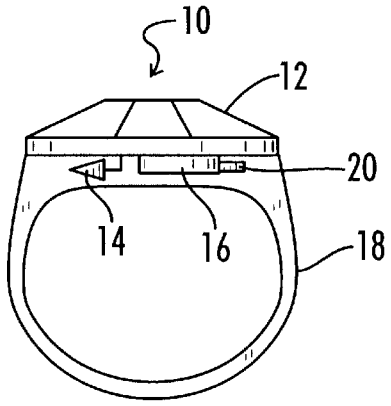
FIG. 5 is a side elevation of a ring according to the present invention.
Figure 6:
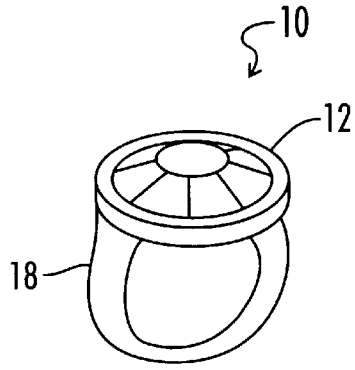
FIG. 6 is perspective view of a ring according to the present invention.
Figure 8:
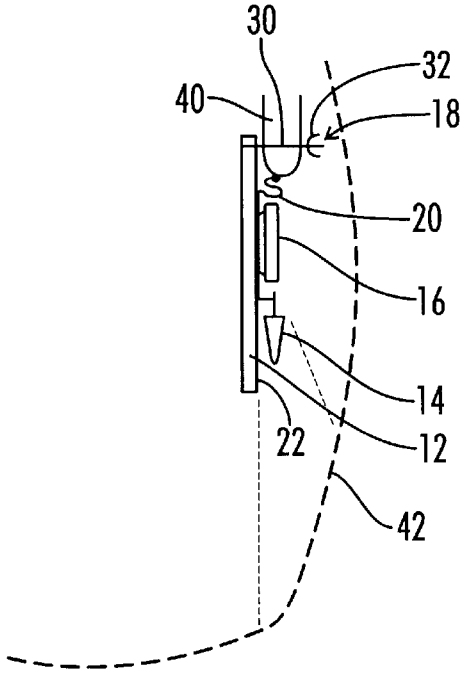
FIG. 8 is a side elevation of an earring showing attachment to a pierced ear lobe.
Figure 9:
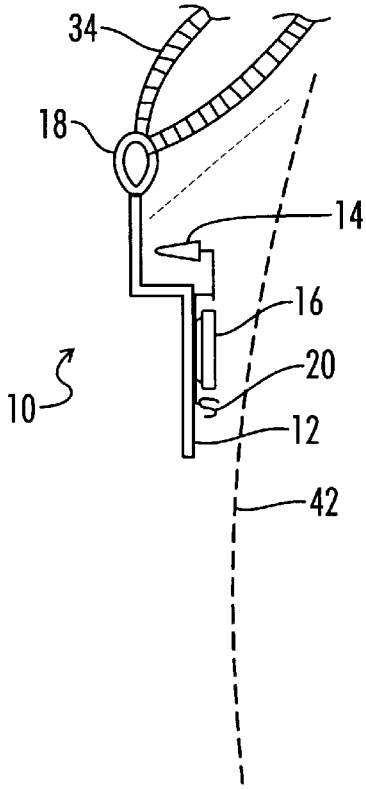
FIG. 9 is a side elevation of a necklace showing illumination of the neck.

As shown in FIGS. 5 and 6, the mounting element 18, also known as the attachment element, provides an enclosure such that a finger or toe may be inserted. As shown in FIGS. 8, 13, and 14, the mounting element 18 further comprises a post 30 and a backing 32 to allow attachment of the surface illuminator 10 to an ear 40. As shown in FIG. 9, in certain embodiments of the present invention, the mounting element 18, also known as the attachment element, attaches the surface illuminator 10 to a chain 34 so that the surface illuminator 10 may be suspended from the neck of the wearer. By allowing attachment of the surface illuminator 10 to the chain 34, a wearer may desire to suspend the surface illuminator 10 in any manner which the wearer believes will allow illumination in a manner which will attract attention to, or enhance, the appearance of the individual. As best shown in FIGS. 11 and 12, in certain embodiments of the present invention, the mounting element 18, also known as the attachment element, provides for attachment of the surface illuminator 10 to hair. In the embodiment in which the surface illuminator 10 is attached to hair, the mounting element 18 encloses a portion of the hair in a manner similar to a hair barrette or a hair clip. As shown in FIG. 12, the mounting element 18 has an open position 36 and a closed position 38.

The present invention discloses a method of enhancing the appearance of a subject. The method requires providing a surface illuminator 10, or a jewelry piece having a light source 14 and having a blocking element 12 that conceals the light source, illuminating the light source, reflecting light emitted from the light source by use of the blocking element, attaching the surface illuminator 10, or jewelry piece described above, to a surface of a subject, and illuminating the surface of the subject with light reflected from the blocking element. In certain embodiments of the present invention, the surface illuminator 10, or jewelry piece having a light source 14 and having a blocking element 12 that conceals the light source, is attached to the surface of an individual in a fixed position relative to the surface of the subject so that illumination of the surface of the subject is consistent. In other embodiments, the surface illuminator 10, or jewelry piece having a light source 14 and having a blocking element 12 that conceals the light source, is attached to an individual so that it is capable of movement relative to the surface of the subject wherein illumination of the surface of the subject is variable. Since the present application includes a description of a surface illuminator 10, such item may be provided based upon the information described herein.

The step of attaching the surface illuminator 10 to the surface of a subject is accomplished by manipulating or maneuvering the mounting element 18. In certain embodiments of the present invention, the surface illuminator 10 is attached to a wrist or ankle by maneuvering the mounting element 18 beyond the hand or foot by stretching the mounting element 18 when it is composed of an elastic or stretching material. Such attachment may be either fixed or loose to provide the desired illumination effect. In certain embodiments, the surface illuminator 10 is attached to the wrist or ankle by unfastening and subsequently refastening the mounting element 18 around the wrist or ankle.

As best seen in FIGS. 3 and 4, in other embodiments, the surface illuminator 10 is attached to a pierced body part, for example an ear, abdomen, eyebrow or nipple, by maneuvering the mounting element 18 into the open position 26, inserting a portion of the mounting element through the pierced tissue, and manipulating the mounting element 18 to the closed position 28. Attachment may result in either a fixed positioning or a loose, dangling, position. The illumination effect will depend upon the type of attachment used. In certain embodiments of the present invention, the surface illuminator 10 is attached to a finger or toe of an individual by inserting the finger or toe into the opening provided by the mounting element 18 as seen in FIGS. 5 and 6. Such attachment will be in a fixed position.

In certain embodiments, the surface illuminator 10 is attached to pierced tissue, as seen in FIGS. 8, 13 and 14, by separating the post 30 from the backing 32, inserting the post 30 into the pierced tissue, and reattaching the post 30 to the backing 32. In still another embodiment of the present invention, the surface illuminator 10, also known as the back-lighting apparatus, attaches to the neck of an individual by inserting a chain 34 through the opening of the mounting element 18, and placing the circular chain 34 around the neck 42 of an individual. Such attachment will result in a loose, dangling, attachment so that the illumination of the surface of the individual will vary upon the movement of the surface illuminator 10. In other embodiments, the surface illuminator 10 is attached to hair, as best seen in FIG. 12, by placing the mounting element 18 in the open position 36, gathering hair and placing it between the mounting element 18 which is in the open position 36 and the blocking element 12, and manipulating the mounting element 18 into the closed position 38, so that the hair is captured within the mounting element 18, which is performing a function similar to a hair barrette or a hair clip.

In certain embodiments, the method of enhancing the appearance of a subject further includes turning off the surface illuminator 10. The light source 14 of the present invention may be turned on or off by manipulating the light control 20. In certain embodiments of the present invention, the light control 20 will allow the light source 14 to be turned or off by depressing a button, moving a lever, or manipulating a dial. In other embodiments of the present invention, the intensity of the light source 14 may be adjusted between a maximum intensity and a minimum intensity. The light control 20 of the surface illuminator 10 may be adjusted to modify the intensity of the light source by depressing a button, maneuvering a lever, or turning a dial. Preferably, the intensity of the light source 14 is modified by manipulating the light control 20, which is in the form of a turning dial. Preferably, the source illuminator 10 is turned on and off by manipulating the light control 20, which is in the form of a depressible button.

Thus, although there have been described particular embodiments of the present invention of new and useful Jewelry Having An Indirect Light Source And Methods Of Use Thereof, it is not intended that such references be construed as limitations upon the scope of this invention except as set forth in the following claims.

What is claimed is:

1. A back-lighting apparatus comprising:

a jewelry piece having a first side;

a light source attached to the first side of the jewelry piece, so that the jewelry piece blocks direct visualization of light from the light source and redirects light to a surface of a subject;

a battery connected to the light source; and an attachment element connected to the jewelry piece so that the back-lighting apparatus attaches to the subject.

2. The back-lighting apparatus of claim 1, wherein the first side of the jewelry piece further comprises a light reflective surface.

3. The back-lighting apparatus of claim 1, wherein the light source is a light emitting diode.

4. The back-lighting apparatus of claim 1, wherein the light source is an incandescent light source.

5. The back-lighting apparatus of claim 1, wherein the light source is a fluorescent light source.

6. The back-lighting apparatus of claim 1, wherein the light source is a liquid crystal display.

* * * * *